US007765742B2

(12) United States Patent
Ealer, Sr.

(10) Patent No.: US 7,765,742 B2
(45) Date of Patent: Aug. 3, 2010

(54) GUTTER COVER

(76) Inventor: James Edward Ealer, Sr., 524 Lakeshore Dr., St. Clair, MO (US) 63077

( * ) Notice: Subject to any disclaimer, the term of this patent is extended or adjusted under 35 U.S.C. 154(b) by 423 days.

(21) Appl. No.: 10/987,930

(22) Filed: Nov. 12, 2004

(65) Prior Publication Data

US 2006/0101722 A1 May 18, 2006

(51) Int. Cl.
*E04D 13/064* (2006.01)
*E04D 13/076* (2006.01)
*E04D 13/04* (2006.01)

(52) U.S. Cl. ..... 52/12; 52/11; 52/15

(58) Field of Classification Search ..... 52/12, 52/11, 15, 13, 98, 302.1; 248/48.2, 48.1; 210/474

See application file for complete search history.

(56) References Cited

U.S. PATENT DOCUMENTS

| | | | | |
|---|---|---|---|---|
| 891,406 | A | 6/1908 | Cassens | |
| 1,597,503 | A | 8/1926 | Andrews | |
| 2,022,255 | A | 11/1935 | Scott | |
| 2,175,521 | A | 10/1939 | Fry | |
| 2,209,741 | A | 7/1940 | Sullivan et al. | |
| 2,271,081 | A | 1/1942 | Layton | |
| 2,988,226 | A | 6/1961 | Campbell | |
| 3,067,881 | A | 12/1962 | Goosmann | |
| 3,108,406 | A | 10/1963 | Ellis | |
| 3,351,206 | A | 11/1967 | Wennerstrom | |
| 3,388,555 | A | 6/1968 | Foster | |
| 3,774,274 | A | 11/1973 | Jury | |
| 3,950,951 | A | 4/1976 | Zukauskas | |
| 4,307,976 | A | 12/1981 | Butler | |
| 4,404,775 | A * | 9/1983 | Demartini | 52/12 |
| 4,418,504 | A | 12/1983 | Lassiter | |
| 4,497,146 | A * | 2/1985 | Demartini | 52/12 |
| 4,631,875 | A | 12/1986 | Olson | |
| 4,695,033 | A | 9/1987 | Imaeda | |
| 4,727,689 | A | 3/1988 | Bosler | |
| 4,750,300 | A | 6/1988 | Winger, Jr. | |
| 4,769,957 | A | 9/1988 | Knowles | |
| 4,796,390 | A | 1/1989 | Demartini | |
| 4,841,686 | A | 6/1989 | Rees | |
| 4,905,427 | A | 3/1990 | McPhalen | |
| 4,907,381 | A | 3/1990 | Ealer | |
| 4,936,061 | A | 6/1990 | Palma | |
| 4,937,986 | A | 7/1990 | Way, Sr. et al. | |
| 4,941,299 | A * | 7/1990 | Sweers | 52/12 |
| D310,259 | S | 8/1990 | Hitchins | |

(Continued)

FOREIGN PATENT DOCUMENTS

DE 3905961 A1 * 9/1989

(Continued)

OTHER PUBLICATIONS

Gutter World, Inc., Price List, Aug. 1, 1985, 4 pages.

(Continued)

*Primary Examiner*—Phi Dieu Tran A
(74) *Attorney, Agent, or Firm*—Senniger Powers LLP

(57) ABSTRACT

A variety of gutter covers and screens are disclosed for preventing debris from falling into a gutter. Also, a variety of clips are disclosed for attaching the covers/screens to the gutter.

33 Claims, 15 Drawing Sheets

U.S. PATENT DOCUMENTS

| | | | | | |
|---|---|---|---|---|---|
| 5,010,696 | A | | 4/1991 | Knittel | |
| 5,072,551 | A | | 12/1991 | Manoogian, Jr. | |
| 5,092,086 | A | | 3/1992 | Rognsvoog, Sr. | |
| 5,095,666 | A | | 3/1992 | Williams, Jr. | |
| 5,103,601 | A | | 4/1992 | Hunt | |
| 5,109,640 | A | | 5/1992 | Creson | |
| 5,251,410 | A | | 10/1993 | Carey | |
| 5,271,191 | A | | 12/1993 | Vahamaki | |
| 5,271,192 | A | | 12/1993 | Nothum, Sr. et al. | |
| 5,406,754 | A | | 4/1995 | Cosby | |
| 5,438,803 | A | | 8/1995 | Blizard, Jr. | |
| 5,457,916 | A | * | 10/1995 | Tenute | 52/12 |
| 5,522,183 | A | | 6/1996 | Allen | |
| 5,611,175 | A | * | 3/1997 | Sweers | 52/12 |
| 5,619,825 | A | | 4/1997 | Leroney et al. | |
| 5,632,128 | A | * | 5/1997 | Agar | 52/489.2 |
| 5,640,809 | A | * | 6/1997 | Iannelli | 52/12 |
| 5,709,051 | A | | 1/1998 | Mazziotti | |
| 5,813,173 | A | | 9/1998 | Way, Sr. | |
| 5,842,311 | A | | 12/1998 | Morin | |
| 5,893,240 | A | | 4/1999 | Ealer, Sr. | |
| 6,151,836 | A | | 11/2000 | McGlothlin | |
| 6,151,837 | A | | 11/2000 | Ealer, Sr. | |
| 6,161,338 | A | * | 12/2000 | Kuhns | 52/12 |
| 6,269,592 | B1 | * | 8/2001 | Rutter | 52/12 |
| 6,516,577 | B2 | | 2/2003 | Pelfrey | |
| 6,568,132 | B1 | | 5/2003 | Walters | |
| 6,598,352 | B2 | | 7/2003 | Higginbotham | |
| 6,672,012 | B2 | * | 1/2004 | Bahroos et al. | 52/11 |
| 6,708,453 | B1 | * | 3/2004 | Hurst et al. | 52/12 |
| 6,883,760 | B2 | | 4/2005 | Seise, Jr. | |
| 6,904,718 | B2 | * | 6/2005 | Fox | 52/12 |
| 6,941,707 | B2 | | 9/2005 | Sigmund | |
| 6,951,077 | B1 | | 10/2005 | Higginbotham | |
| D523,538 | S | | 6/2006 | Brochu | |
| 7,104,012 | B1 | * | 9/2006 | Bayram | 52/12 |
| 7,191,564 | B2 | | 3/2007 | Higginbotham | |
| 7,310,912 | B2 | | 12/2007 | Lenney | |
| 2006/0201068 | A1 | | 9/2006 | Shane | |

FOREIGN PATENT DOCUMENTS

| | | | | |
|---|---|---|---|---|
| DE | 3829384 | A1 | * | 3/1990 |
| JP | 11264160 | A | | 9/1999 |

OTHER PUBLICATIONS

Gutter World,Inc., The Ultimate Guards brochure, 1985, 2 pages.
Office Action dated Oct. 24, 2007, U.S. Appl. No. 11/105,653, 24 pages.
Office action regarding U.S. Appl. No. 11/566,446; 38 pages.
Office action regarding U.S. Appl. No. 11/567,919; 17 pages.

* cited by examiner

GUTTER COVER

BACKGROUND OF THE INVENTION

The present invention relates generally to rain gutters and more particularly to a gutter cover for preventing debris from falling into such gutters.

Since leaves and other debris frequently clog up rain gutters, some kind of guard or screen which prevents debris from falling into the gutter is desirable. Ideally, a gutter screen directs water into the gutter, prevents debris from entering the gutter, does not itself become clogged with debris and is securely attached to the gutter. The ideal gutter screen requires no maintenance after installation.

Conventional gutter screens are made of hardware cloth, expanded metal or perforated sheet metal, which have holes that often trap debris instead of allowing the debris to slide over the screen. Debris may build up in the holes and cause rainwater to bypass the holes and flow over the gutter instead of into the gutter, or may cause rainwater to build up above the gutter. The debris must thereafter be removed from the screens by hand. Thus, many conventional gutter screens are not maintenance free.

Some prior art screens have holes of smaller diameter to prevent debris from becoming trapped. However, these smaller holes do not allow enough rainwater to flow into the gutter during a heavy rainfall. This is undesirable because the excess water may back up above the gutter or may flow over the screen and gutter. Reference is made to U.S. Pat. Nos. 5,893,240 and 6,151,837, both of which are incorporated by reference herein for all purposes, for additional background information regarding existing gutter screens.

Furthermore, some prior art gutter covers are held in place by fasteners attached to the roof that require holes in the roof along the length of the gutter. Also, some prior art gutter covers may require the use of a bending machine during installation to properly install the cover on the roof.

A need exists for a gutter cover that prevents debris from falling into the gutter and directs water flow into the gutter preventing overflow of the gutter and a gutter cover that is easier to install while maintaining precise spacing between the cover and a front wall of the gutter.

SUMMARY OF THE INVENTION

In general, an aspect this invention is directed to a gutter cover for preventing debris from falling into the gutter and for directing water flow into the gutter. The gutter cover comprises an elongate sheet having a longitudinal axis transverse to a water flow direction. The sheet includes a shingle mounting portion for reception between a roof shingle and roof. The mounting portion includes a flat section, an edge and an edge margin having a longitudinal bend formed so that the edge is angled downward relative to the central area. A covering portion is adjacent the shingle mounting portion and sized to extend over the gutter. The covering portion includes a debris separator for separating the debris from the water flow. A surface tension curve downstream from the covering portion directs water into the gutter. The curve has a varying slope so that surface tension causes the water to adhere to the curve and be directed into the gutter. A lowermost edge of the sheet is disposed downstream from the surface tension curve. A bend line separates the mounting portion from the covering portion. The bend line extends parallel to the longitudinal axis and includes weakened metal to facilitate bending to an angle for conforming the mounting portion to the roof.

In another aspect of the invention, the gutter cover comprises an elongate sheet having a longitudinal axis transverse to a water flow direction and including a shingle mounting portion for reception between a roof shingle and roof and a covering portion adjacent the shingle mounting portion and sized to extend over the gutter. The covering portion includes a debris separator for separating the debris from the water flow. The debris separator includes spaced apart holes through the sheet. A surface tension curve downstream from the covering portion for directs water into the gutter. The sheet has a lowermost edge disposed downstream from the surface tension curve and a bend line separating the mounting portion from the covering portion. The bend line extends parallel to the longitudinal axis and includes a line of spaced apart holes through the sheet for weakening the metal to facilitate bending to an angle. The sheet is unperforated except for the holes of the debris separator and the bend line.

In yet another aspect of the invention, the gutter cover comprises an elongate continuous sheet having a longitudinal axis transverse to a water flow direction. The sheet includes a shingle mounting portion for reception between a roof shingle and roof, a covering portion adjacent the shingle mounting portion and sized to extend over the gutter, a curved portion downstream from the covering portion for directing water into the gutter, and a lowermost edge disposed downstream from the curved portion. A clip includes a fastening portion for fastening the clip to a flange of the gutter, a receiver for receiving the lowermost edge of the cover, and a spacing portion for spacing the cover from the flange.

In still another aspect of the invention, the gutter cover is adapted for covering a gutter and preventing debris from falling into the gutter. The gutter having front, back and bottom walls and a flange projecting rearwardly from the front wall and spaced above the bottom wall of the gutter. The flange extends substantially continuously along the entire length of the gutter. The cover comprises an elongate sheet including a generally flat central portion and a front edge margin integrally formed with the central portion and bent relative to the central portion to form a forwardly opening channel generally V-shaped in transverse section extending substantially continuously along the entire length of the cover for receiving the gutter flange therein. The sheet has a rear edge margin formed integrally with the central portion and bent at an angle of between about 90 and about 120 degrees with respect to the central portion. The sheet is no greater than 0.10 inches thick.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
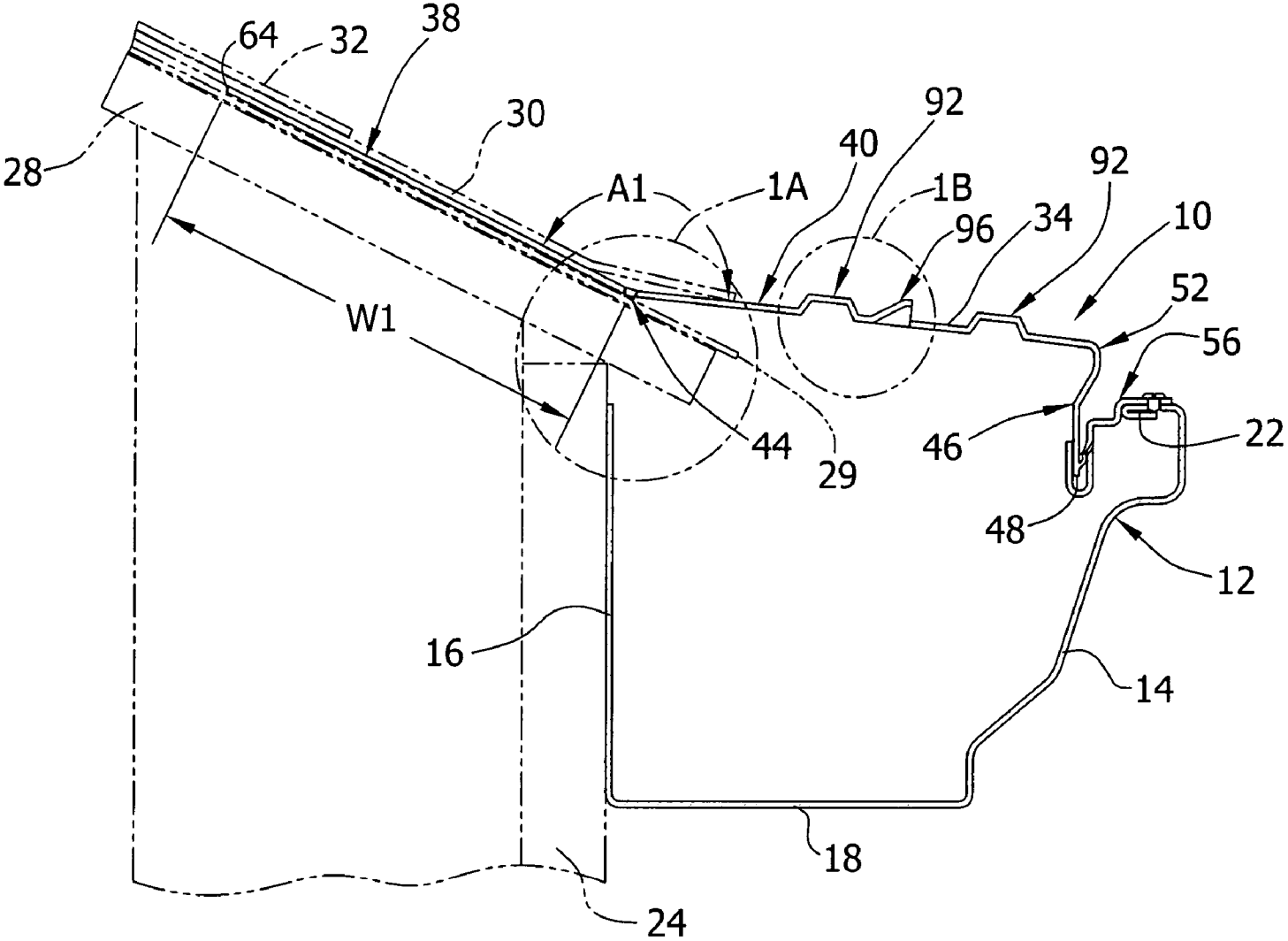
FIG. 1 is a transverse cross-sectional view of a gutter cover of the present invention installed on a gutter.
Figure 2:
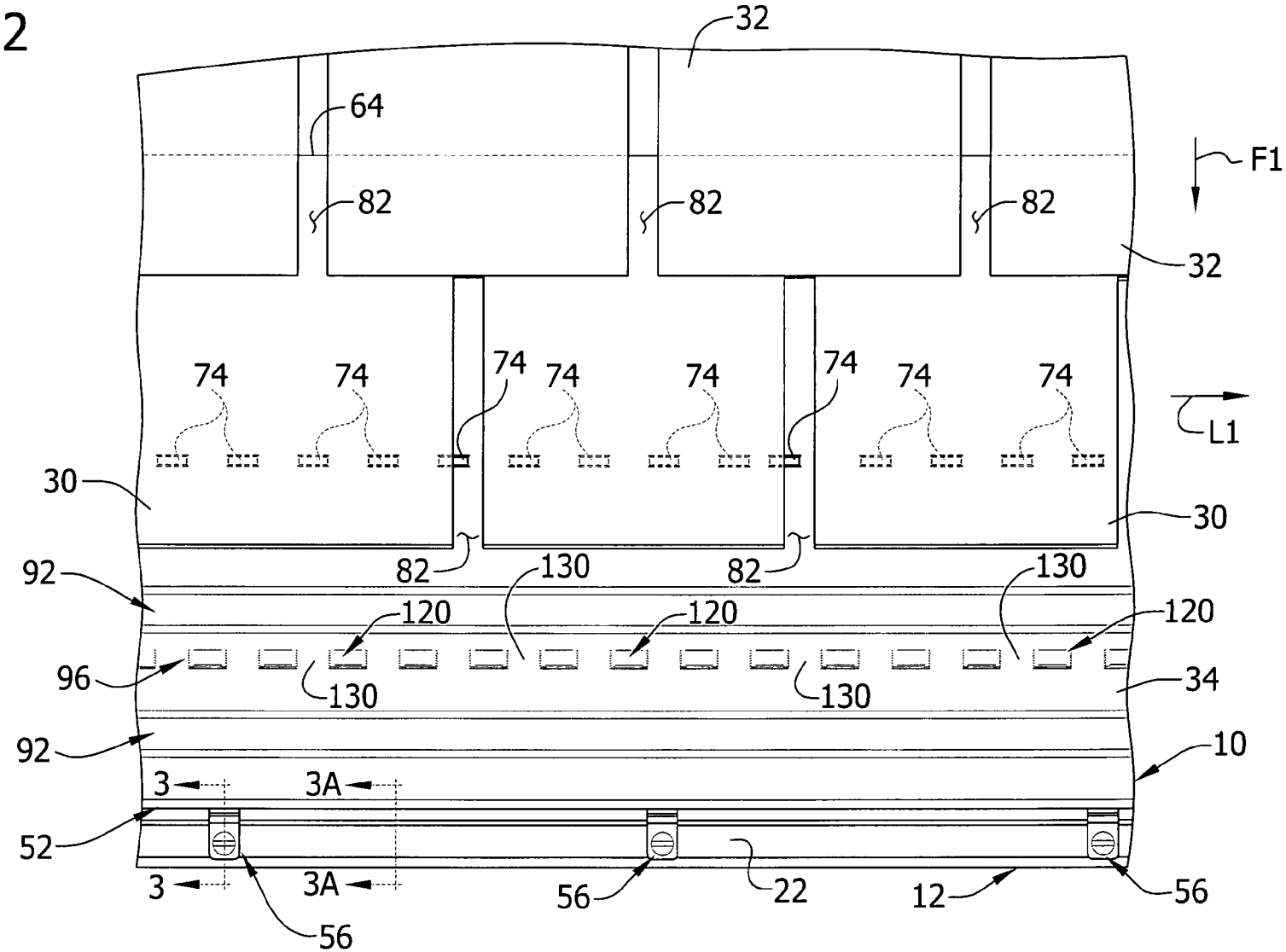
FIG. 2 is a fragmentary top plan view of the gutter cover of FIG. 1.

Now referring to the drawings, a gutter cover of a first embodiment is generally designated 10. The gutter cover is particularly adapted for covering a conventional rain gutter 12 and preventing debris from falling into the gutter. As shown in FIG. 1, the gutter 12 has a front wall 14, a back wall 16 and a bottom wall 18, which combine to form a channel for drainage of rainwater. A conventional flange 22 projects rearwardly (i.e., toward the building) from the upper edge of the front wall 14. The gutter 12 is suitably attached to a wall 24 of the building by gutter hangers (not shown) to collect rainwater flowing off a downwardly sloping roof 28 of the building. As shown in FIG. 2, a starter row of shingles 29 are attached to the roof 28 to overhang the lower edge margin of the roof, a first (lower) row of shingles 30 are attached to the roof 28 above the starter row of shingles, and a second row of shingles 32 are attached to the roof generally above the lower row. As is discussed in detail below, the gutter cover 10 of this embodiment is held in place between the shingles 30, 32 and is attached to the flange 22 of the gutter 12. The gutter cover 10 receives water from the roof 28 and directs the water across the top surface of the cover and into the gutter 12.

The gutter cover 10 comprises an elongate sheet 34 having a longitudinal axis L1 (FIG. 2) transverse to the direction F1 of water flow down the roof. The sheet 34 includes an upper, shingle mounting portion 38 for reception between the first row shingles 30 and the starter row shingles 29 next to the roof 28, a covering portion 40 adjacent the shingle mounting portion sized to extend over the gutter 12, a bend line 44 separating the mounting portion and the covering portion, and a downwardly extending flange 46 adjacent the covering portion forming a lowermost edge 48 of the cover. The sheet 34 has a surface tension curve 52 for directing water from the covering portion 40 onto the downwardly extending flange 46 and into the gutter 12. In the illustrated embodiment, the cover 10 is attached to the gutter 12 by clips, generally indicated 56, affixed to the cover flange 46 and the gutter flange 22. In one embodiment, the sheet 34 is made of sheet metal (e.g., aluminum) but it is understood that the sheet may include or be made of other materials (e.g., plastic, vinyl, etc.)

As shown in FIGS. 1 and 2, the shingle mounting portion 38 is substantially flat, continuous, unbroken and uninterrupted. The shingle mounting portion 38 is inserted between the first row of shingles 30 and the starter row shingles 29 so that the cover 10 is held in place, at least in part, by the weight of the shingles attached to the roof and the friction force between the shingles and the cover. The shingle mounting portion 38 has a top surface 60 in contact with the shingles 30, a bottom surface 62 in contact with the roof 28, and an upper edge 64 that wedges between the shingles 30 and the roof 28 when installing the cover 10 on the roof. The shingle mounting portion 38 is sized to have a lateral width W1 so that a portion of the top surface of the cover 10 is in contact with the shingles 30 and at least a portion of the bottom surface of the cover is in contact with the starting row shingles 29 next to the roof 28. In one embodiment, the shingle mounting portion 38 may have a width of about 1 inch to 7 inches, in one embodiment about 5 inches.

The bend line 44 is located upstream of the lower edge of the first row of shingles 30 and extends parallel to the longitudinal axis L1 of the cover and comprises a bend 70 in the sheet 34 that separates the shingle mounting portion 38 from the covering portion 40. In the illustrated embodiment, the bend 70 is configured such that bend angle A1 between the covering portion 40 and the shingle mounting portion 38 is about 135 degrees, but it is understood that the angle A1 could vary depending on the slope of the roof 28.

Figure 1A:
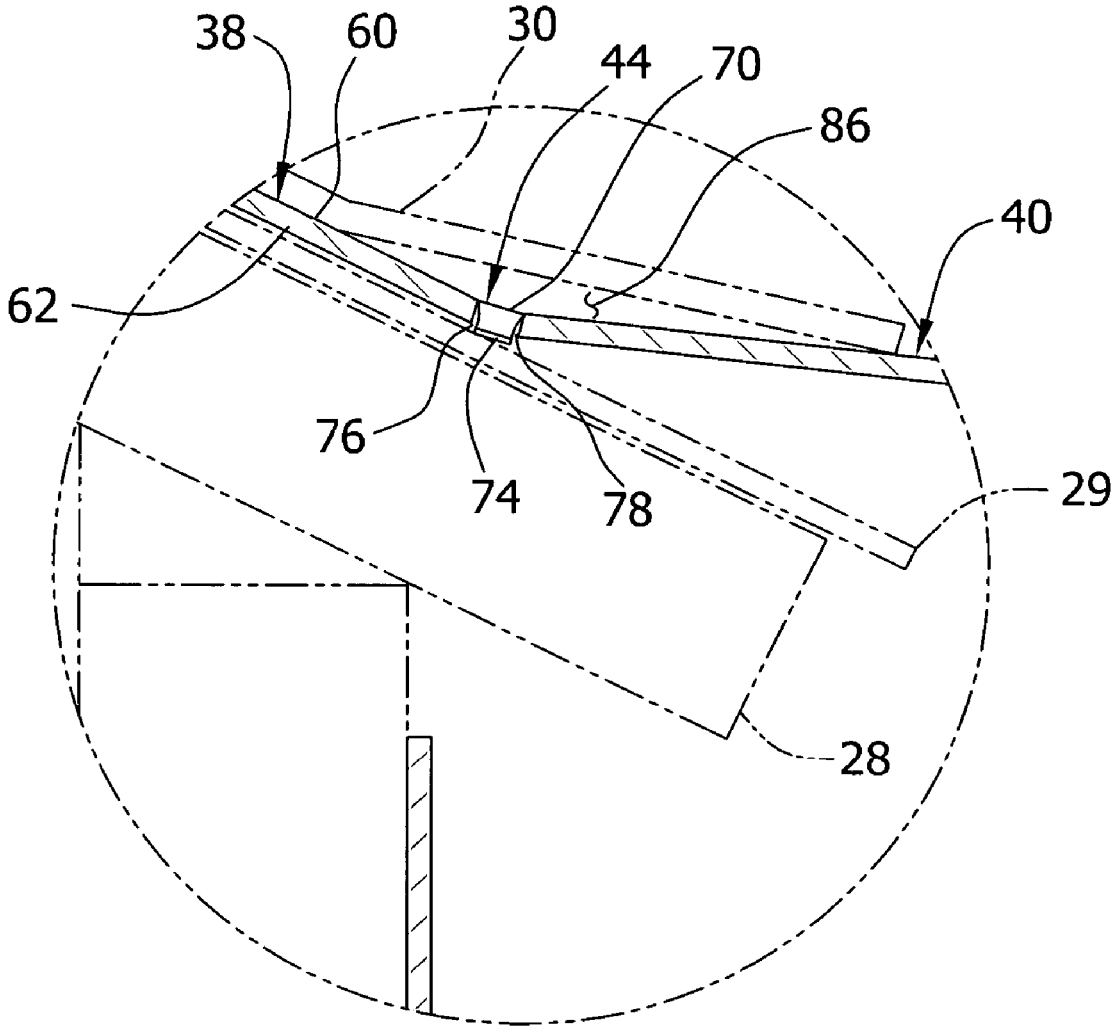
FIG. 1A is an enlarged portion of FIG. 1.

As shown in FIGS. 1A and 2, the bend line 44 comprises a portion of the sheet 34 that has a series of downwardly struck sections 74 equally spaced across the longitudinal length of the cover 10. As shown in FIG. 1A, the downwardly struck sections 74 have openings 76, 78 on both sides to weaken the sheet 34 along the bend line 44 so that the sheet may be easily manipulated when installing the cover 10. The sheet 34 may be manipulated along the bend line 44 so that a correct bend angle A1 may be easily set at the jobsite in accordance with the pitch of the roof 28, and without requiring additional work or machinery at the jobsite to weaken the sheet during installation.

As shown in FIG. 2, the shingles 38, 40 typically have a shingle gap 82 between the adjacent shingles on each row. The bend line 44 is located below the first row of shingles 38 such that the bend angle A1 creates a change in direction of the flow path of water flowing down the shingle gap 82 on the cover. As shown in FIG. 1A, the space between the cover 10 at the bend angle A1 and the first row of shingles 38 creates a pocket 86 that collects water flowing down the shingle gap 82. The pocket 86 causes the flow of water down the shingle gap 82 to collect at the bend angle A1 between the shingle mounting portion 38 and the covering portion 40 of the sheet 34. As water fills the pocket 86, the water is distributed more evenly across the longitudinal length of the cover 10 prior to flowing onto the covering portion 40 of the cover.

Figure 1B:
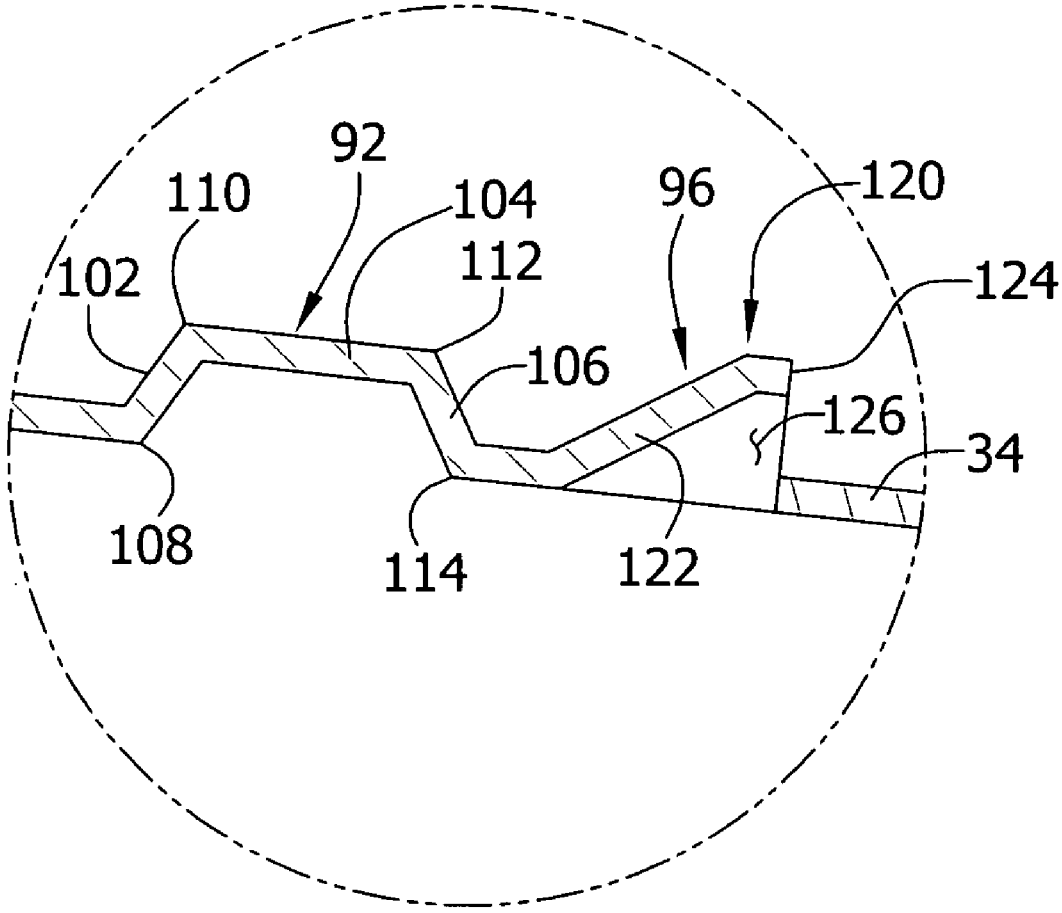
FIG. 1B is an enlarged portion of FIG. 1.

In the illustrated embodiment, the covering portion 40 has two spaced apart ribs, generally indicated 92, extending the length of the sheet 34 and a debris separator 96 located between the ribs. As shown in FIG. 1B, each rib 92 includes an upper ramp portion 102, a top wall 104 generally parallel to the covering portion of the sheet 34, and a lower ramp portion 106. The ribs 92 each have a first bend 108 connecting the upper ramp 102 with the covering portion 40 of the sheet 34, a second bend 110 connecting the upper ramp with the top wall 104 of the rib, a third bend 112 connecting the top wall with the lower ramp 106, and a fourth bend 114 connecting the lower ramp with the covering portion of the sheet.

The ribs 92 stiffen the covering portion 40 of the sheet 34 to inhibit flexing or bending of the covering portion. The ribs 92 thereby allow the sheet 34 to be made of a thinner sheet of material. The sheet 34 may be made of material having a thickness no greater than 0.10 inch. In one embodiment, the sheet 34 is made from aluminum having a thickness of about 0.032 inch, but it is understood that other materials and thickness may be used. For example, the sheet 34 may be made of vinyl or plastic and have a thickness of about 0.050 inch.

The ribs 92 distribute the water flow across the longitudinal length of the cover 10 so that the water does not flow in discrete flow paths or streams spaced along the length of the cover. The even distribution of water across the longitudinal length of the cover 10 increases the surface tension holding the water to the cover and prevents the water from flowing over the flange 22 of the gutter 12. The first bend 108 of each ramp 92 creates a change in direction that allows water flowing down the covering portion 40 of the cover 10 to momentarily collect against the upper ramp portion 102 of each rib prior to the water flowing over the top wall 104 of the rib. The water that collects against the upper ramp portion 102 is distributed across the longitudinal length of the cover 10 prior to flowing across the top wall 104 of the ramp 92 and down the lower ramp portion 106. The water distributed across the longitudinal length of the cover 10 has an increased surface tension, as compared to discrete streams, that hold the water to the top surface of the cover.

The debris separator 96 separates debris (e.g., leaves) from the water flowing over the cover 10. As shown in FIG. 1B, the debris separator 96 includes a series of upwardly struck portions, generally indicated 120, of the sheet 34 that each have a ramp 122 and a free end 124 spaced apart from the sheet. In the illustrated embodiment, each of the free ends of the upwardly struck portions form an opening 126 in the sheet 34, (so that portions form "perforated louvers") but it will be understood that the debris separator 96 may be formed without openings in the sheet without departing from the scope of this invention. Also, the debris separator 96 could comprise downwardly struck sections of the sheet 34 or have ramps 122 that are otherwise shaped (e.g., curved) without departing from the scope of this invention. In the illustrated embodiment the upwardly struck portions 120 are aligned in a row parallel to the longitudinal length of the sheet, but could be otherwise arranged.

As shown in FIG. 2, the debris separator 96 includes unbroken portions 130 of the sheet 34 located between each of the spaced apart upwardly struck portions 120. As water and debris contact the ramp 122 of the upwardly struck portions 120 of the sheet 34, the water tends to flow around the ramp across the unbroken portion of the sheet between the upwardly struck portions of the debris separator 96 with some of the water flowing over the ramp and through the openings. As the water and debris pass over the upwardly struck portions 120, the surface tension holding the debris is broken by air pockets formed between the upwardly struck portions. In some embodiments, the ramp 122 of the debris separator 96 may have a height ranging from about 1/16 inch to 1/4 inch, in one embodiment about 1/8 inch, and a width ranging from about 1/8 inch to 1 inch, in one embodiment about 3/8 inch. The broken surface tension between the debris and the water flowing over the cover 10 created by the debris separator 96 causes the debris to separate from the water.

Figure 3:
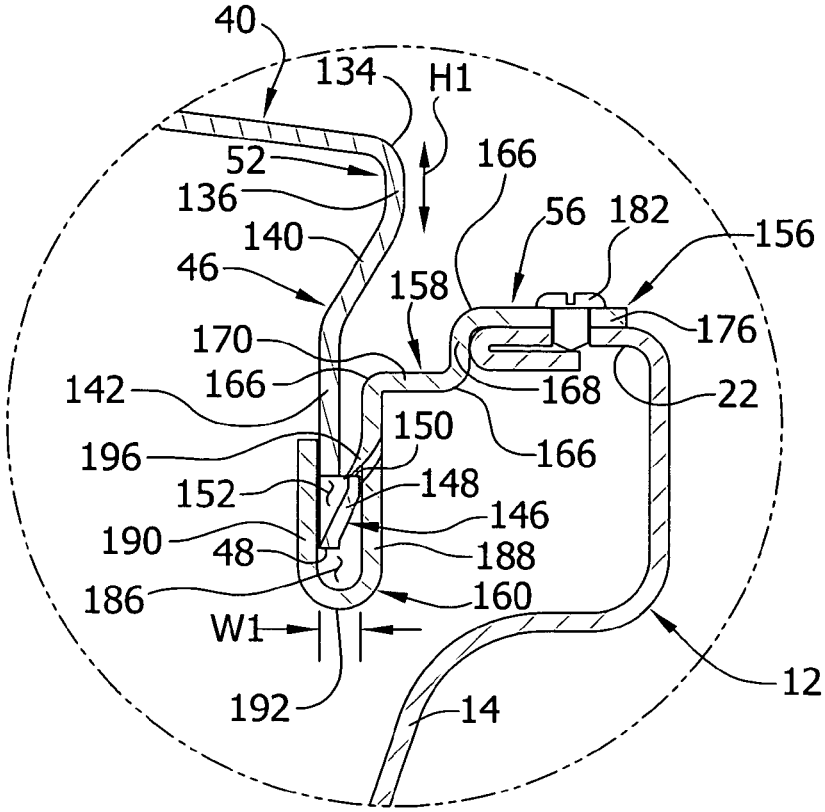
FIG. 3 is an enlarged portion of FIG. 1.

The surface tension curve 52 of the cover 10 directs the water flowing down the covering portion 40 of the cover onto the flange 46 and into the gutter 12. As shown in FIG. 3, the surface tension curve 52 has a varying slope with a first concave upper curve 134 adjacent the covering portion 40 of the sheet 34 and a second concave lower curve 136 adjacent the first curve. In the illustrated embodiment, the upper curve 134 has a smaller radius of curvature than the lower curve 136. The lower curve 136 has a larger radius of curvature requiring less surface tension for the water to adhere to the sheet 34 as the water flows over the surface tension curve 52. As such, the water flowing down the sheet 34 adheres to the sheet when flowing over the surface tension curve 52 and does not overflow the gutter 12. Any debris that reaches the surface tension curve 52 will not be adhered to the water so that it will not enter the gutter 12. The momentum of the debris will tend to carry it over the edge of the gutter 12.

In some embodiment, the upper curve 134 may have a radius of curvature ranging from about 1/8 inch to 1/2 inch, in one embodiment about 3/8 inch, and the lower curve 136 may have a radius of curvature ranging from about 1/4 inch to 1 inch, in one embodiment about 5/8 inch. It is understood that instead of two distinct curves 134, 136, the surface tension curve 52 may comprise a continuous curved surface having a varying (e.g, increasing) radius of curvature.

In some embodiments, the surface tension curve 52 may have a height H ranging from about 1/2 inch to 1 3/4 inch, in this embodiment about 1 inch. The reduced height of the curve 52 allows the gutter cover 10 to have a lower profile and a more appealing look as compared to prior art covers.

The downwardly extending flange 46 extends from the surface tension curve 52 and forms the lowermost edge 48 of the gutter cover 12. As shown in FIG. 3, the flange 46 has an angled upper portion 140 connected to the lower curve 136 of the surface tension curve 52 and a substantially vertical lower portion 142. In the illustrated embodiment, the lower portion 142 of the flange has holding ribs generally indicated 146 (only one of which is shown in FIG. 3) in the form of longitudinally spaced apart outwardly struck portions 148 that have a free, upper end 150 forming an opening 152 for receiving a portion of the clip 56. The holding ribs 146 of the flange 46 are engageable with the holding clips 56 that secure the cover 10 to the gutter 12. The holding ribs 146 may comprise a bent section without openings for engagement with the clips 56, or any other arrangement to secure the cover 10 to the clips, without departing from the scope of this invention.

Figure 3A:
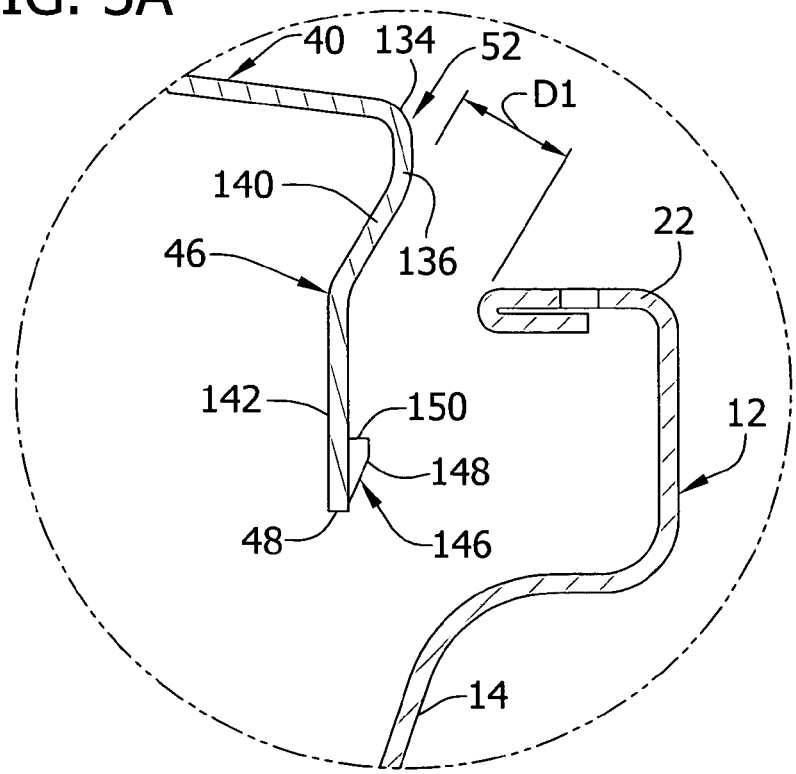
FIG. 3A is an enlarged cross-section taken along the plane including line 3A-3A of FIG. 2.
Figure 4A:
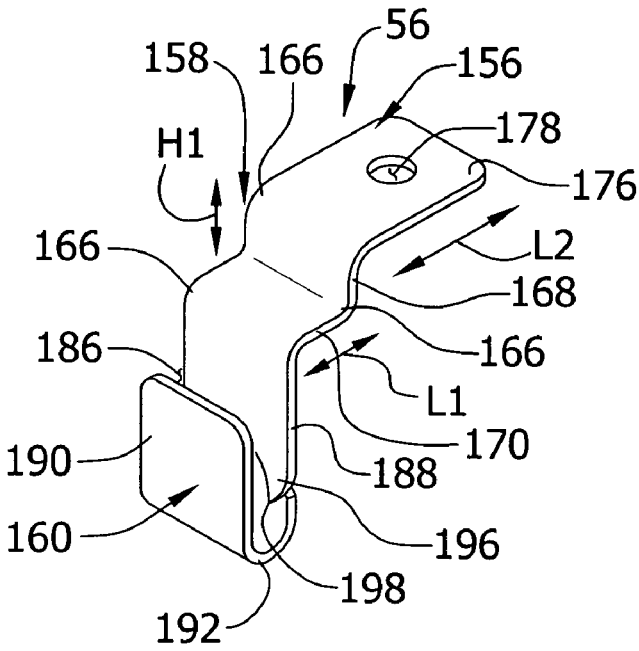
FIG. 4A is a detail perspective of a clip.
Figure 4B:
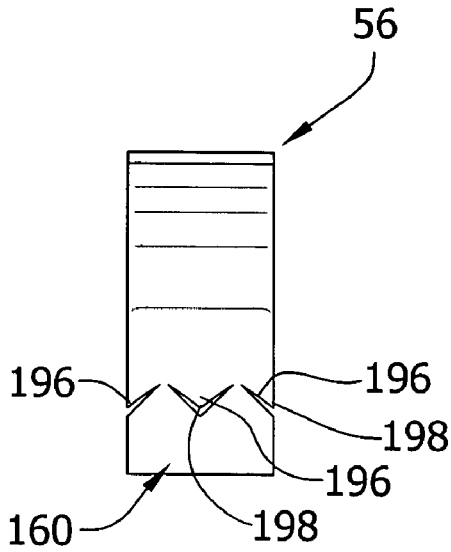
FIG. 4B is a rear elevation of the clip of FIG. 4A.

Each clip 56 attaches the cover 10 to the gutter 12 and is connected to the downwardly extending flange 46 of the cover on one end and the flange 22 of the gutter 12 on the other end. As shown in FIGS. 3, 3A, and 4A, the clips 56 have a fastening portion, generally indicated 156, for fastening the clip to the gutter 12, a spacer, generally indicated 158, for spacing the cover 10 from the gutter flange 22 by a distance D1 (FIG. 3A), and a receiver, generally indicated 160, for receiving the lower edge 48 of the cover. The distance D1 between the cover 10 and the gutter flange 22 is small enough to prevent debris from falling into the gutter 12 and large enough to allow the water into the gutter so that water does not fall outside the gutter.

The spacer 158 includes three ninety degree bends 166, a vertical section 168, and a horizontal section 170. As seen in FIG. 3, the vertical section 168 of the spacer 158 contacts the flange 22 of the gutter 12 when the clip 56 is installed on the gutter. The vertical section 168 has a height H1 (FIG. 4A) that may range from about 1/16 inch to 1/4 inch (in one embodiment about 1/8 inch), and the horizontal section has a length L1 (FIG. 4A) ranging from about 1/16 inch to 1/4 inch (in one embodiment about 1/8 inch). The spacer 158 is suitably sized so that the distance D1 ranges from about 1/32 inch to 1/2 inch, in one embodiment about 1/8 inch. As shown in FIGS. 3 and 4A, the fastener portion 156 includes a substantially flat tab 176 generally parallel to the top surface of the gutter flange 22. The tab 176 extends from the top bend 166 of the spacer 158 and has an opening 178 for receiving a screw 182 or other fastener (e.g., rivet) that attaches the clip 56 to the flange 22 of the gutter 12. The fastener portion 156 has a length L2 (FIG. 4A) suitably ranging from about 1/4 inch to 3/4 inch, in one embodiment about 3/8 inch. The opening 178 may have a diameter ranging from about 1/16 inch to 1/4" (more preferably about 1/8") to accommodate various size fasteners 182 for connecting the clip 56 to the gutter flange 22.

The receiver portion 160 of the clip 56 has a generally U-shaped cross-section forming an opening 186 that receives the downwardly extending flange 46 and the lower edge 48 of the cover 10. The receiver 160 has an inner wall 188 and outer wall 190 that are spaced apart and connected by a 180 degree bend 192 at the bottom of the clip 56. The outer wall 190 extends down from the lower bend 192 of the spacer 158 and includes a row of barbs 196 that are struck outwardly from the plane of the wall. The barbs 196 are shaped to engage the holding ribs 146 on the downwardly extending flange 46 of the cover 10. In the embodiment of FIGS. 1-4B, each barb 196 has a pointed free end 198 that engages the holding ribs 146 on the flange 46 of the cover 10. It is understood that the holding ribs 146 may be omitted so that the barbs 196 engage the flat surface of the flange 46 to secure the clips 56 to the cover 10, without departing from the scope of this invention.

Figure 5A:
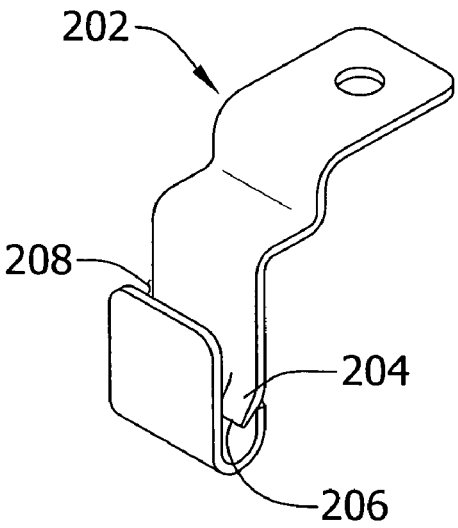
FIG. 5A is a detail perspective of a second embodiment of the clip.
Figure 5B:
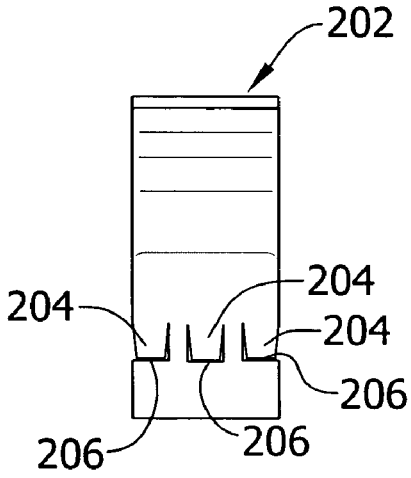
FIG. 5B is a rear elevation of the clip of FIG. 5A.

Each barb 196 has a length ranging from about 1/16 inch to about 1/4 inch (more preferably about 1/8 inch). More or less than three barbs 196 may be provided on each clip 56 and the barbs may be arranged in multiple rows on the receiver 160. It is understood that the barbs 196 may have other shapes and sizes than described herein without departing from the scope of this invention. For example, FIGS. 5A and 5B show an alternative embodiment of the clips 202 having a row of barbs 204 with flat free ends 206.

The inner wall 188 of the receiver 160 has a free end spaced away from the outer wall 190 to form the opening 208 for receiving the downwardly extending flange 46 of the cover 10. The opening 208 suitably has a width W1 (FIG. 3) ranging from about 1/16 inch to 1/4 inch (in one embodiment about 1/8 inch) so that the flange 46 engages the barb 196 on one side and the innermost wall 188 of the receiver 160 on the other side.

Figure 6:
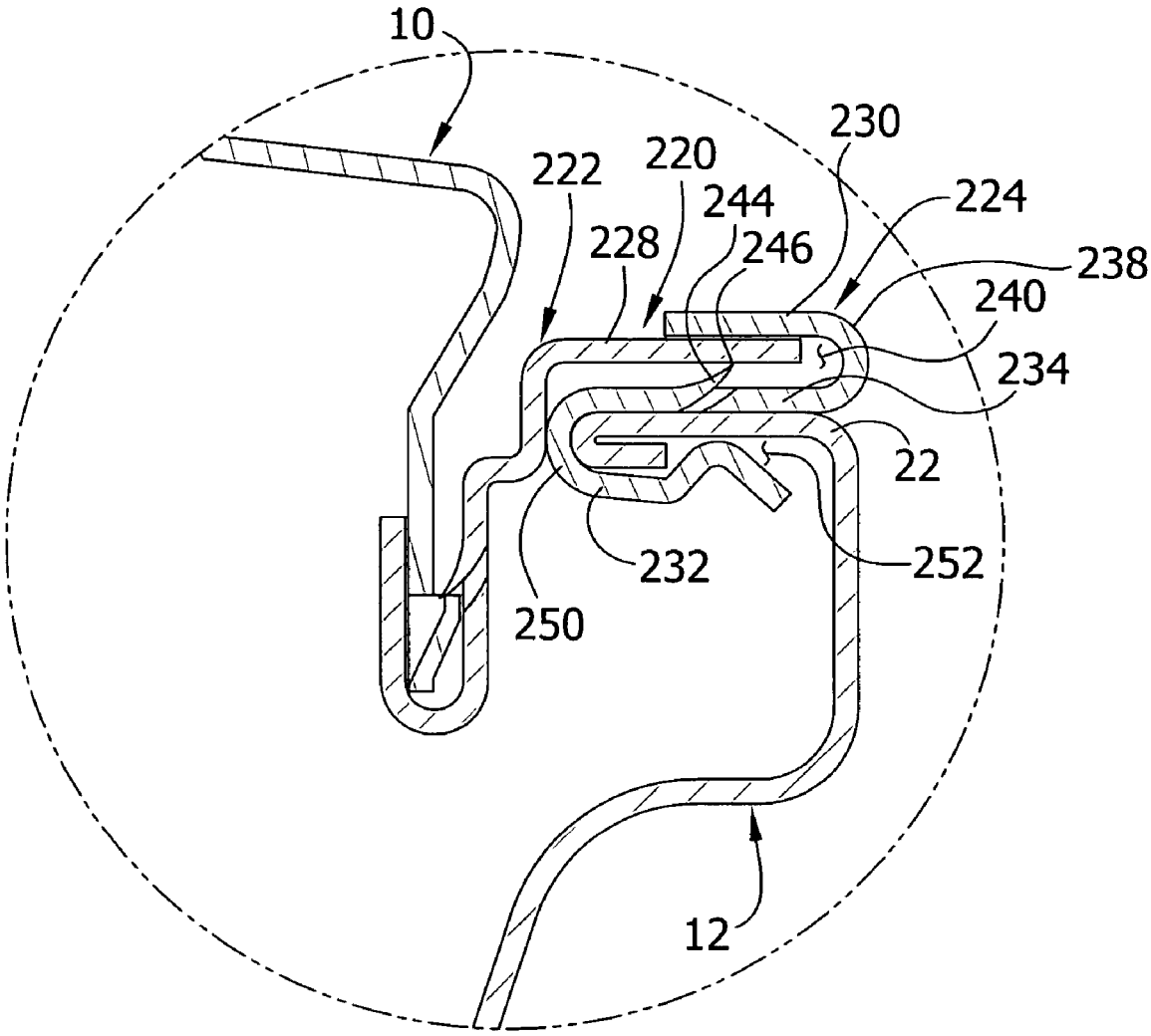
FIG. 6 is an enlarged cross-section similar to FIG. 3 but showing a third embodiment of the clip.

FIG. 6 shows an alternate embodiment of the invention in which the cover 10 is attached to the gutter by a clip assembly, generally designated 220, including a first clip, generally indicated 222, similar to the clip 56 illustrated in FIGS. 1-4 and a second clip, generally indicated 224, attached to a fastener portion 228 of the first clip. As shown in FIG. 6, the second clip 224 as a generally inverted S-shaped cross-section with an upper wall 230, a lower wall 232, and an intermediate wall 234. An upper 180 degree bend 238 connects the upper wall 230 and intermediate wall 234 and forms a gap 240 therebetween for receiving the fastener portion 228 of the first clip 222. In the illustrated embodiment, the second clip 224 has a barb 244 upwardly struck from the intermediate wall 234 such that the barb has a free end 246 that extends into the gap 240. The barb 244 engages the bottom surface of the fastener portion 228 of the first clip 222 so that the first and second clip 224 are held in secure engagement.

The second clip 224 has a second 180 degree bend 250 that connects the intermediate wall 234 and the lower wall 232 and forms a gap 252 therebetween for receiving the gutter flange 22. In one embodiment, the second clip 224 is made of a flexible material (e.g., aluminum or steel) having a thickness ranging from about 0.01 inch to about 0.10 inch, in one embodiment about 0.024 inch, so that the bottom wall 232 acts as a spring finger that may flex away from the intermediate wall 234 to widen the gap 252 for attachment of the clip to the flange 22 of the gutter 12. The bottom wall 232 of the second clip 224 is biased against the gutter flange 22 so that a holding force against the gutter flange secures the second clip and gutter cover 10 to the gutter 12.

Figure 7:
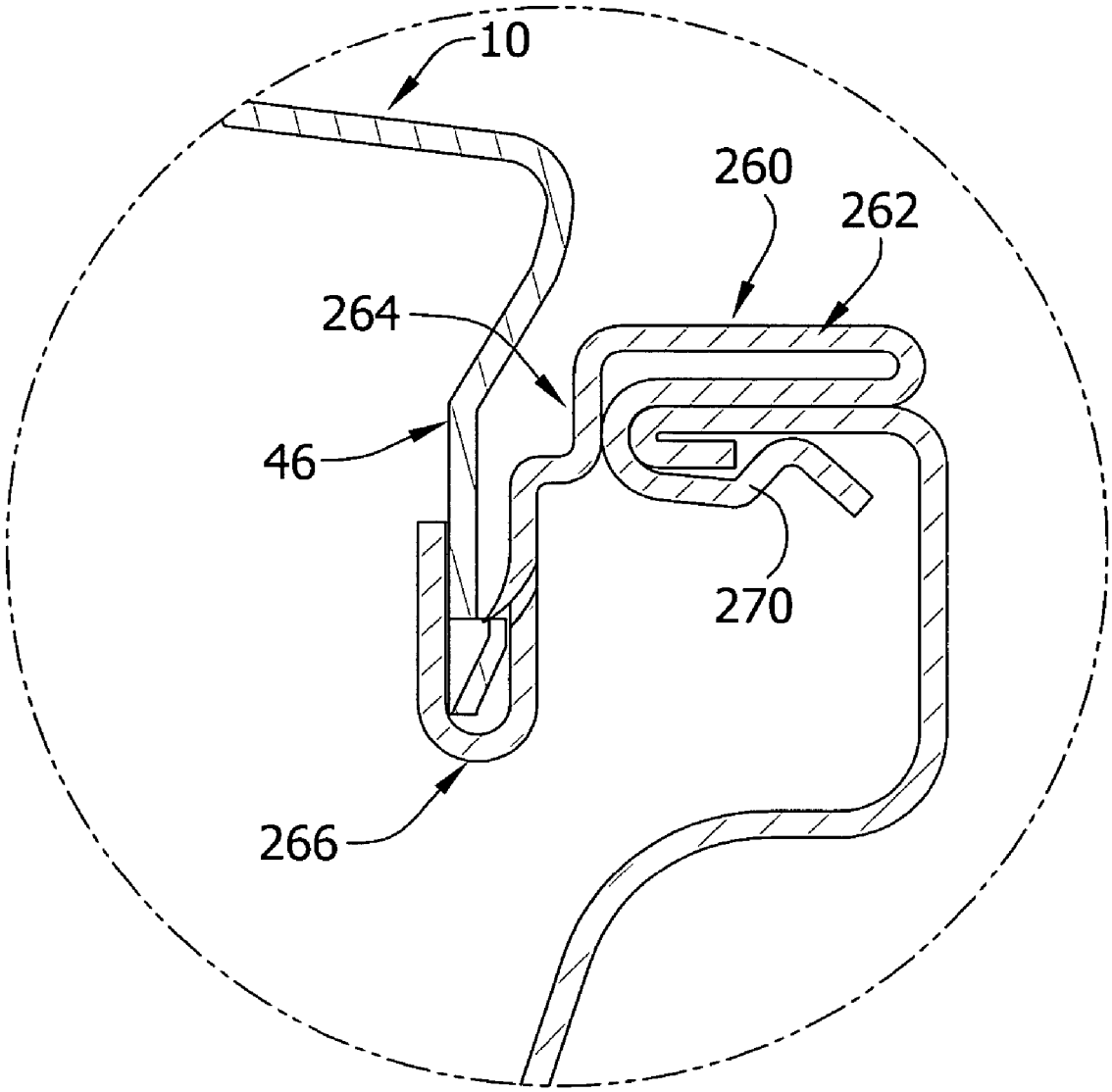
FIG. 7 is a view similar to FIG. 6 but showing a fourth embodiment of the clip.

FIG. 7 shows an alternative embodiment of a one-piece holding clip, generally indicated 260, similar to the two-piece clip assembly of FIG. 6, but formed of a single piece of material. As with the previous embodiments, the clip 260 has a fastening portion 262 for attaching the clip to the gutter 12, a spacer 264 for spacing the cover away from the gutter by the proper distance D1, and a receiver portion 266 having a generally U-shaped cross-section for receiving the downwardly extending flange 46 of the cover 10. The fastener portion 262 of the clip 260 is similar to the two-piece design of FIG. 6 in that the clip has a spring biasing member 270 that presses against the gutter 12 to secure the clip to the gutter. The fastening portion 262, receiver 266, and spacer 264 of the clip are formed integrally as a single piece of bent sheet metal.

Figure 8:
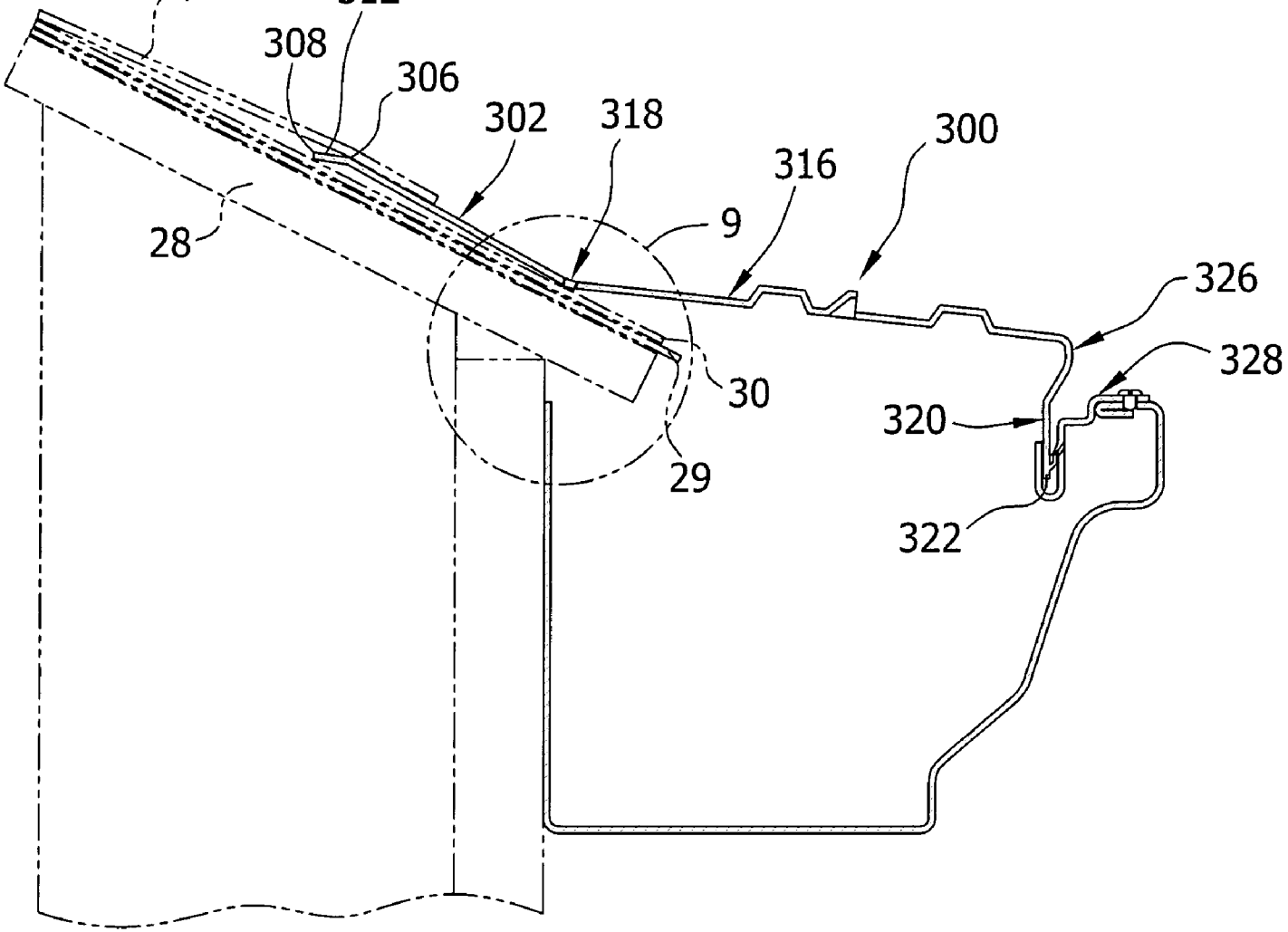
FIG. 8 is a transverse cross-sectional view of a second embodiment of the gutter cover installed on the gutter.
Figure 9:
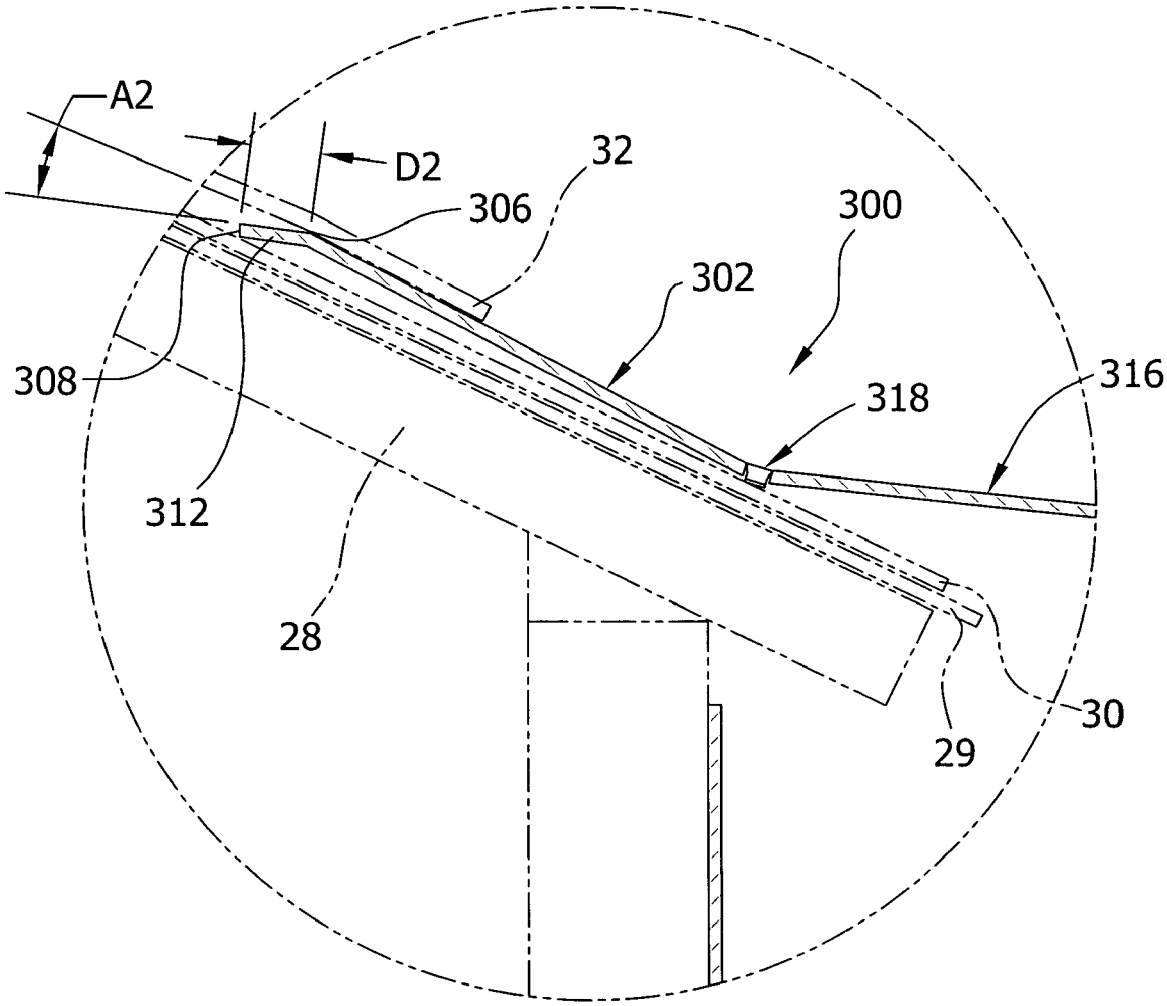
FIG. 9 is an enlarged portion of FIG. 8.

FIGS. 8 and 9 show a second embodiment of the gutter cover, generally designated 300, that is held in place below the second row of shingles 32 on the roof 28. The gutter cover 300 of this embodiment is similar to the previous embodiment except the shingle mounting portion 302 is extended so that the cover may be mounted beneath the second row of shingles 32 on the roof 28.

The shingle mounting portion 302 includes a continuous sheet that has an upper bend 306 located generally adjacent to an upper free end 308 of the cover 300. As shown in FIG. 9, a downwardly bent portion 312 of the cover 300 contacts the top surface of the first row of shingles 30 to prevent water in the shingle gap 82 of the second row of shingles 32 from flowing under the cover. In one embodiment, the upper bend 306 is spaced away from the free end 308 of the cover 300 by a distance ranging from about 1/4 inch to 2 inches, in one embodiment about 1 1/4". The bent portion 312 of the cover 300 may form an angle A2 relative to the top surface of the cover ranging from about 15 degrees to 75 degrees, in one embodiment about 30 degrees. This downwardly bent portion 312 may also be used with the embodiment of FIG. 1.

As in the previous embodiments, the cover 300 has a covering portion 316 adjacent the shingle mounting portion 302 sized to extend over the gutter 12, a bend line 318 separating the mounting portion and the covering portion, and a downwardly extending flange 320 adjacent the covering portion forming a lower edge 322 of the cover. The cover 300 has a surface tension curve 326 downstream from the covering portion 316 connecting the covering portion with the flange 320 for directing water from the covering portion onto the downwardly extending flange and into the gutter 12. Some or all of these features may be omitted within the scope of the invention.

In the illustrated embodiment, the cover 300 is attached to the gutter by clips 328 affixed to the downwardly extending flange 320 of the cover and the gutter flange 12. It is understood that the cover 300 of this embodiment may be attached to the gutter 12 by other clips as described herein (e.g., two-piece clip assembly or one-piece clip without fasteners) or other means without departing from the scope of this invention.

Figure 10:
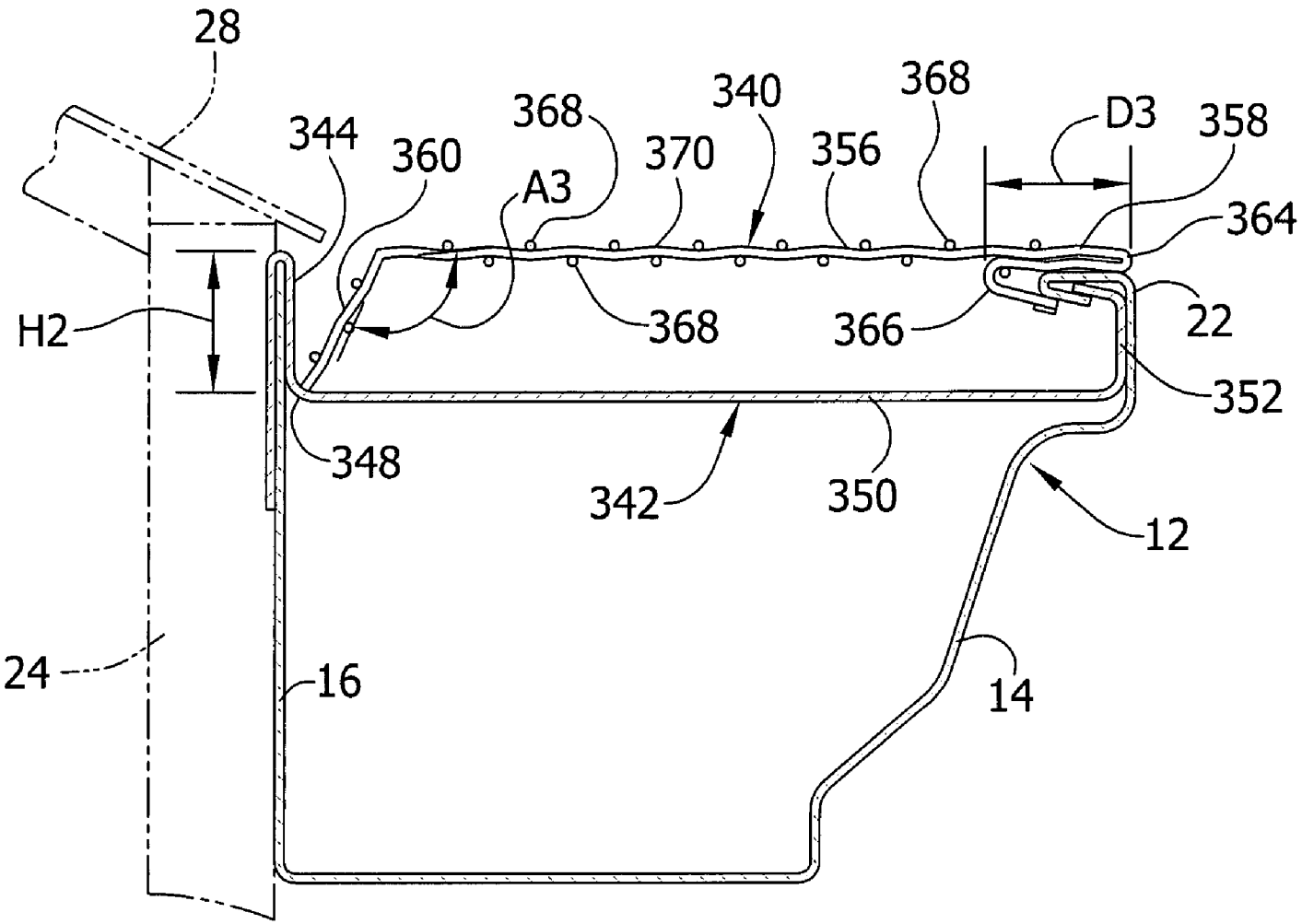
FIG. 10 is a transverse cross-sectional view of a third embodiment of the gutter cover installed on the gutter.

FIG. 10 shows an alternative embodiment of a gutter cover, generally indicated 340, that is sized to fit generally between the opposed walls 14, 16 of the gutter 12. The gutter 12 is attached to the outside wall 24 of a building by gutter hangers, one of which is shown and designated 342. The hanger has a back portion 344 bent to hook over the back wall 16 of the gutter 12 and adapted to receive a fastening device, such as a screw or nail (not shown), to secure the gutter to a wall 24 adjacent the roof 28. The hanger 342 has a 90 degree bend 348 that connects the back portion 344 with a central portion 350 of the hanger that extends over the channel formed by the opposed walls 14, 16 of the gutter 12 to support the front wall and reinforce it against inwardly directed pressures, such as are frequently caused by ladders leaning against the gutter. A front portion 352 of the hanger 340 is bent to fit inside the gutter flange 22 to reinforce the front wall 14 against outwardly directed forces, such as caused by someone pulling on the gutter while climbing onto roof.

As shown in FIG. 10, the cover 340 has a generally flat central portion 356, a front edge margin 358 formed integrally with the central portion and bent downwardly to contact the front wall 14 of the gutter 12, and a rear edge margin 360 formed integrally with the central portion and bent downwardly to contact the rear portion 344 of the gutter hanger 342. The front edge margin 358 has an upper bend 364 and a lower bend 366 so that the front edge margin of the cover 340 is bent relative to the central portion 350 to form a channel having a generally V-shaped cross section for receiving the gutter flange 22 therein. The rear edge margin 360 engages the bend 348 in the hanger 342 so that the gutter cover 340 is held in place by the contact of the rear edge margin with the hanger and the front edge margin 358 with the gutter flange 22.

In the embodiment of FIG. 10, the gutter cover 340 comprises a flexible resilient metal, such as an aluminum or steel alloy, and is of integral construction, that is, it is formed from a single continuous section of screening. The gutter cover 340 includes strands of spaced apart wire 368 running perpendicular to edge margins of the cover and strands of spaced apart wire 370 running parallel to the edge margins, the parallel and perpendicular strands being interwoven with one another to form a unitary wire mesh screen having openings therein. The wire mesh screen allows water to enter the gutter 12 through the openings between the strands 368, 370 but prevents debris from passing through the cover 340. A gutter cover made from similar material is disclosed in U.S. Pat. No. 4,907,381, incorporated by reference herein for all purposes. It is understood that the gutter cover 340 may comprise other materials (e.g., a continuous sheet of metal, vinyl, or plastic having machined holes, or wire mesh having smaller or larger openings) that allow water to flow into the gutter 12 and prevent the entry of debris into the gutter or any other material that is resilient so that it can be bent into the configuration shown and held there in tension.

In one embodiment, the gutter cover 340 has a height H2 ranging from about ½ inch to 1½ inch, in one embodiment about 1⅛ inch. The V-shaped cross section of the front channel may have a depth D3 ranging from about ½ inch to 1½ inch, in one embodiment about ¾ inch. The bend 366 of the front edge margin forming the lower channel of the cover 340 may have a radius ranging from about 1/16 inch to ⅝ inch, in one embodiment about ⅛ inch. In one embodiment the angle A3 between the rear edge margin 360 and the central portion 350 of the cover is about 120 degrees, but this angle may vary.

Figure 11:
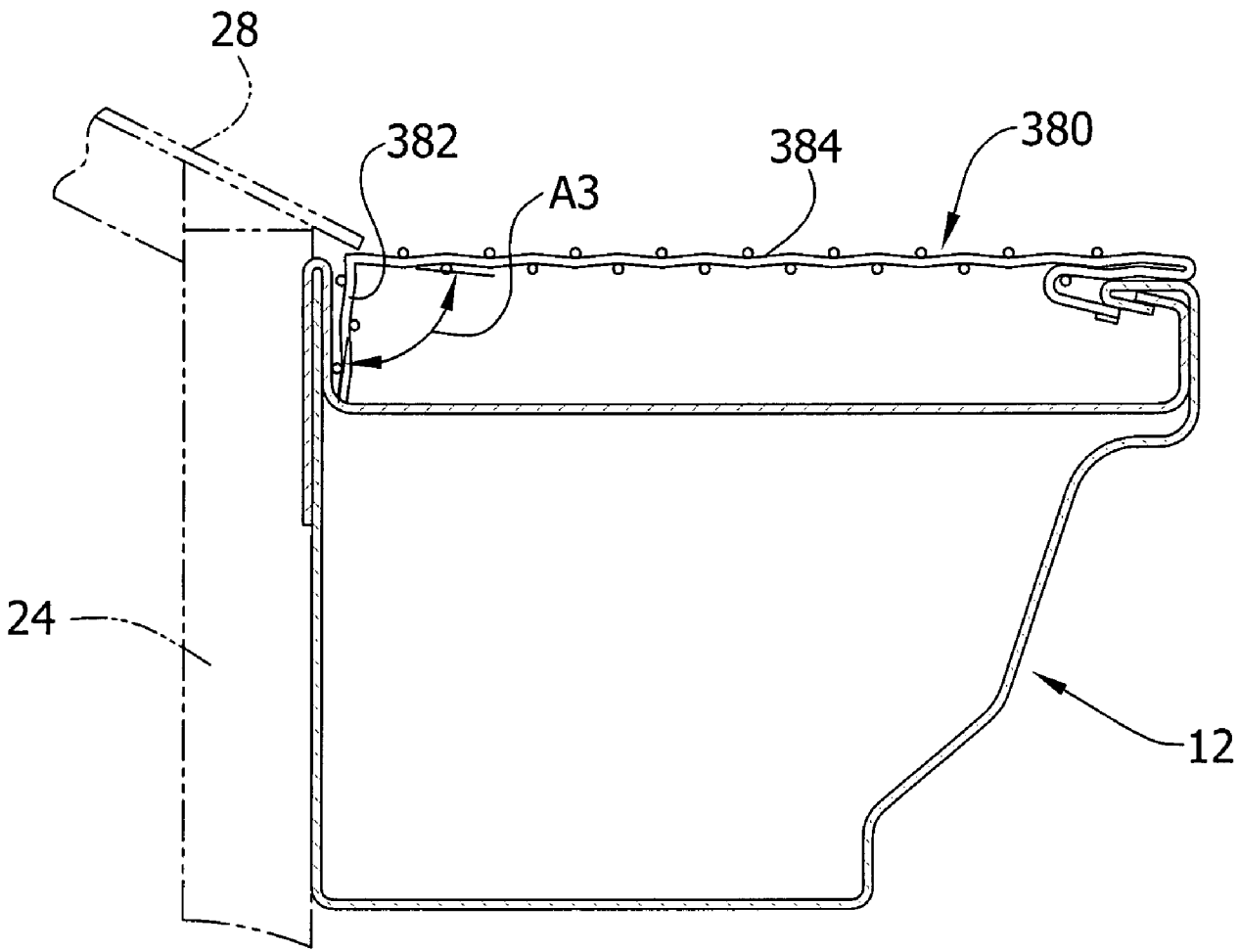
FIG. 11 is a view similar to FIG. 10 but showing a fourth embodiment of the gutter cover.

FIG. 11 illustrates an alternative embodiment of the gutter cover 380 substantially similar to the previous embodiment except the cover has an angle A3 between the rear edge margin 382 and the central portion 384 of the cover of about 90 degrees. The rear edge margin 382 of the cover 380 is angled generally parallel to the back wall 16 of the gutter 12 so that the space between the roof 28 and the top of the cover is reduced to decrease the possibility of leaves or other debris becoming caught between the cover and the roof.

Figure 12:
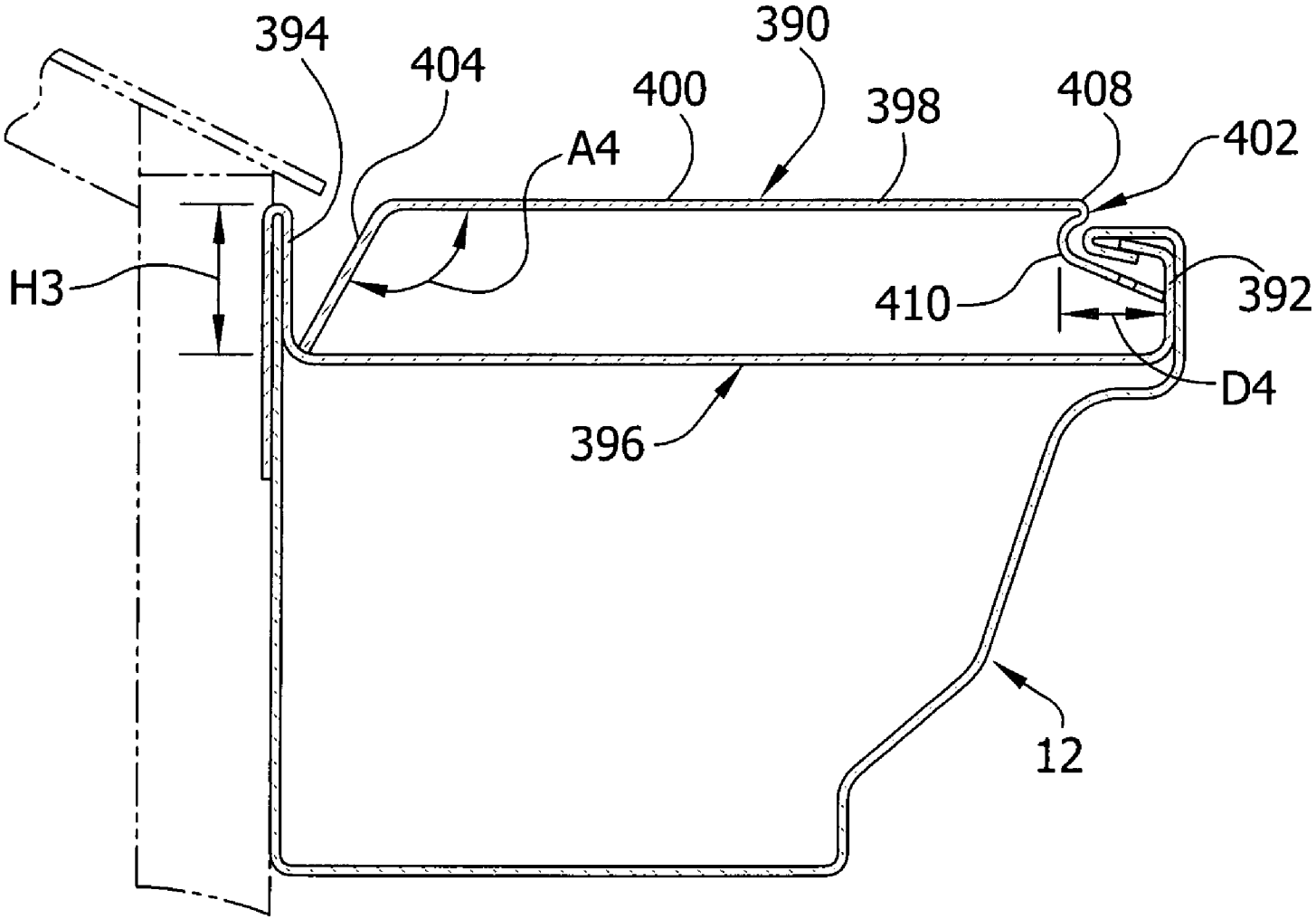
FIG. 12 is a transverse cross-sectional view of a fifth embodiment of the gutter cover installed on the gutter.
Figure 13:
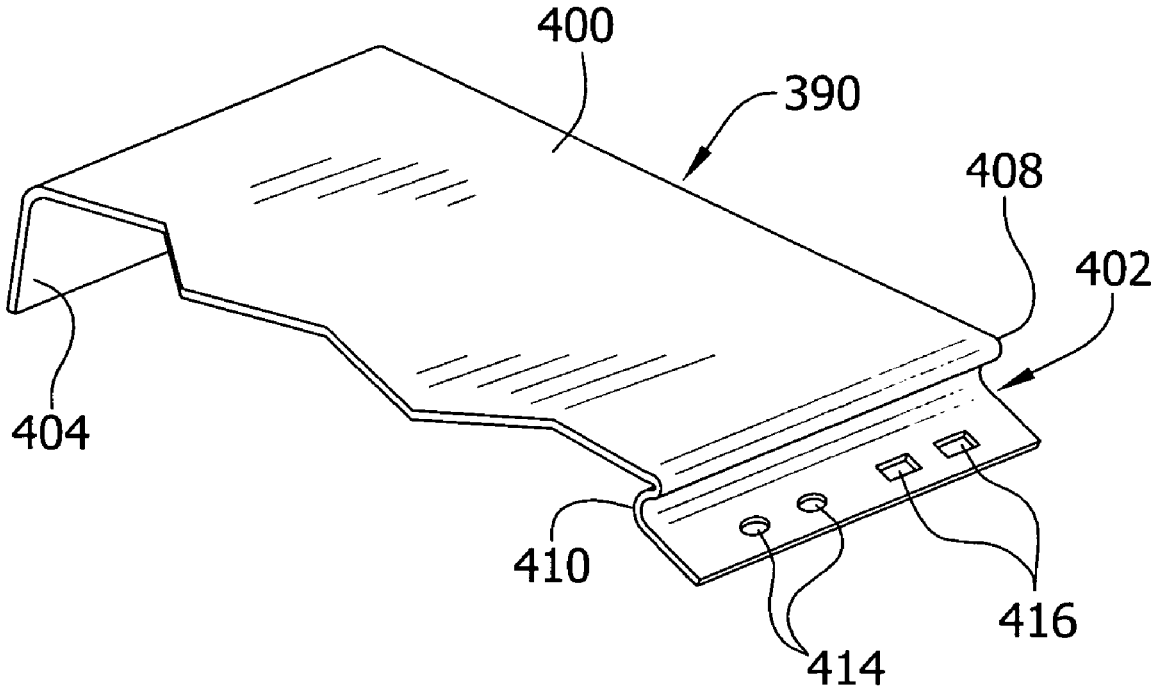
FIG. 13 is a fragmented perspective of the gutter cover of FIG. 12 removed from the gutter.

FIGS. 12 and 13 illustrate an alternative embodiment of the gutter cover 390 that is held in place between the front portion 392 and back portion 394 of the gutter hanger 396. The gutter cover 390 of this embodiment comprises a substantially continuous (non-perforated) sheet 398 having a generally flat central portion 400, a front portion 402 formed integrally with the central portion and bent downwardly to contact the front portion 392 of the gutter hanger 396, and a rear edge margin 404 formed integrally with the central portion and bent downwardly to contact the rear portion 394 of the gutter hanger. The gutter cover 390 is held in place above the channel of the gutter 12 by the contact of the front portion 402 of the cover with the front portion 392 of the gutter hanger 396 and the contact of the rear edge margin 404 of the cover with the rear portion 394 of the gutter hanger. In the embodiment of FIGS. 12 and 13, the cover 390 has an angle A4 between the rear edge margin 404 and the central portion 400 of the cover of about 120 degrees. The rear edge margin 404 contacts the bend 404 in the gutter hanger 396 so that the cover 390 is held in secure engagement in the gutter 12.

The front portion 402 of the gutter cover 390 comprises a top bend 408 and a lower bend 410 having a larger radius than the top bend so as to create a generally V-shaped channel for receiving the inner surface of the gutter flange 22. As shown in FIG. 13, the front edge margin of the gutter cover 390 has spaced apart openings 414, 416 located along the longitudinal length of the cover for the flow of water through the cover and into the gutter 12. In the illustrated embodiment, the openings 414 are circular and the openings 416 are rectangular shape but the openings may be other shapes and sizes (e.g., elongate slots) without departing from the scope of this invention. The discrete openings 414, 416 may be replaced by a single elongate opening without departing from the scope of this invention.

In one embodiment, the cover 390 has a height H3 above the gutter hanger 396 ranging from about ½ inch to 1½ inch, in one embodiment about 1⅛ inch. The V-shaped channel of the front portion 402 of the cover 390 may have a depth D4 ranging from about ½ inch to 1¼ inch, in one embodiment about ¾ inch. The radius of curvature of the lower bend 410 may range from about ¼ inch to ⅝ inch, in one embodiment more preferably about ⅜ inch. The circular openings 414 may have a diameter ranging from about ⅛ inch to ¾ inch, in one embodiment about ⅜ inch, and the rectangular openings 416 may have a length and width ranging from about ⅛ inch to 1¼ inch, in one embodiment about ¼ inch by ½ inch. The cover may be made of suitable materials (e.g., metal, vinyl, plastics, etc.) and have a thickness no greater than about 0.1 inches.

Figure 14:
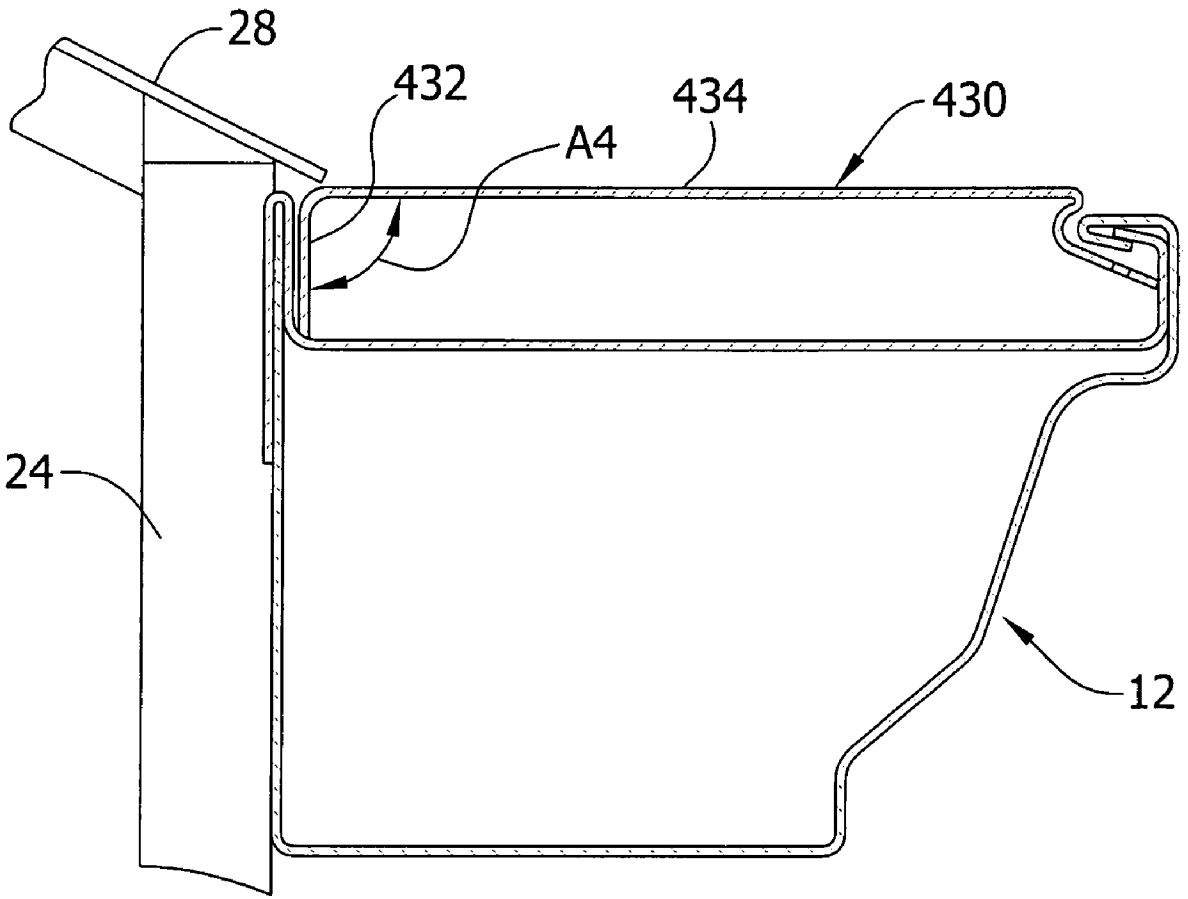
FIG. 14 is a view similar to FIG. 12 but showing a sixth embodiment of the gutter cover.

FIG. 14 illustrates an alternative embodiment of the gutter cover 430 substantially similar to the previous embodiment except the cover has an angle A4 between the rear edge margin 432 and the central portion 434 of the cover of about 90 degrees. The rear edge margin 432 of the cover 430 is generally parallel to the back wall 16 of the gutter 12 so that the space between the roof 28 and the top of the cover is reduced to decrease the possibility of leaves or other debris becoming caught between the cover and the roof.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. Further, all dimensional information set forth herein is exemplary only and is not intended to limit the scope of the invention. It is understood that any of the particular embodiments of the present invention may include one or more of the aspects or features of the invention as described herein and illustrated in the drawings.

What is claimed is:

1. A gutter cover for preventing debris from falling into the gutter and for directing water flow into the gutter, the gutter cover comprising:

an elongate sheet having a longitudinal axis transverse to a water flow direction, the sheet including:

a shingle mounting portion for reception between a roof shingle and roof;

a covering portion adjacent the shingle mounting portion and sized to extend over the gutter;

a surface tension curve downstream from the covering portion for directing water into the gutter, the curve having a varying slope so that surface tension causes the water to adhere to the curve and be directed into the gutter, said surface tension curve comprising an upper rearward opening concave curve defined by a first radius and a lower rearward opening concave curve defined by a second radius larger than the first radius;

a lowermost edge disposed downstream from the surface tension curve; and a bend line separating the mounting portion from the covering portion, the bend line extending parallel to the longitudinal axis and including weakened metal to facilitate bending to an angle for conforming the mounting portion to the roof, wherein said first radius is in the range of ⅛ in. to ½ in.

2. The gutter cover set forth in claim 1 wherein the bend line includes a line of spaced apart holes through the sheet, the sheet being continuous and including no other holes therethrough.

3. The gutter cover set forth in claim 1 further comprising a clip in combination with the cover, the clip connecting the cover to a flange of the gutter and including a fastening portion for fastening the clip to the gutter flange, and a step-shaped spacer comprising a generally vertical section extending from the fastening portion for contact with the gutter flange and a generally horizontal section extending from the generally vertical section for spacing the lowermost edge of the cover from the gutter flange.

4. The gutter cover set forth in claim 1 further comprising a clip in combination with the cover, the clip comprising a fastening portion for fastening the clip to the gutter, a receiver for receiving the lowermost edge of the cover, and a step-shaped spacer comprising a generally vertical section extending down from the fastening portion for contact with the gutter flange and a generally horizontal section extending from a lower end of the generally vertical section for spacing the receiver from the gutter flange.

5. The gutter cover set forth in claim 4 wherein the receiver is configured to extend downward into the gutter and perpendicular to the fastening portion.

6. The gutter cover set forth in claim 4 wherein the receiver of the clip includes at least one barb for inhibiting withdrawal of the cover from the clip.

7. The gutter cover set forth in claim 4 wherein the fastening portion includes an opening for receiving a screw for attaching the clip to the gutter.

8. , The gutter cover set forth in claim 1 wherein the sheet is made of material selected from the group comprising metal, plastic, and vinyl.

9. The gutter cover set forth in claim 1 further comprising at least one rib formed in the covering portion for stiffening the sheet and for promoting smooth, even water flow.

10. The gutter cover set forth in claim 9 wherein the covering portion includes at least two of said ribs.

11. The gutter cover set forth in claim 10 wherein each rib projects upwardly.

12. The gutter cover set forth in claim 11 wherein each rib is formed by four bends formed in the covering portion.

13. A gutter cover for preventing debris from falling into the gutter and for directing water flow into the gutter, the gutter cover comprising:

an elongate sheet having a longitudinal axis transverse to a water flow direction, the sheet including:

a shingle mounting portion for reception between a roof shingle and roof;

a covering portion adjacent the shingle mounting portion and sized to extend over the gutter;

a surface tension curve downstream from the covering portion for directing water into the gutter, said surface tension curve comprising an upper rearward opening concave curve defined by a first radius and a lower rearward opening concave curve defined by a second radius larger than the first radius;

a lowermost edge disposed downstream from the surface tension curve;

a bend line separating the mounting portion from the covering portion, the bend line extending parallel to the longitudinal axis and including a line of spaced apart holes through the sheet for weakening the metal to facilitate bending to an angle;

wherein said first radius is in the range of ⅛ in. to ½ in.

14. The gutter cover set forth in claim 13 further comprising a clip in combination with the cover, the clip being configured for connecting the cover to a flange of the gutter and including a fastening portion for fastening the clip to the gutter flange, and a step-shaped spacer comprising a generally vertical section extending from the fastening portion for contact with the gutter flange and a generally horizontal section extending from the generally vertical section for spacing the lowermost edge of the cover from the gutter flange.

15. The gutter cover set forth in claim 13 further comprising a clip in combination with the cover, the clip comprising a fastening portion for fastening the clip to the gutter, a receiver for receiving the lowermost edge of the cover, and a step-shaped spacer comprising a generally vertical section extending down from the fastening portion for contact with the gutter flange and a generally horizontal section extending from a lower end of the generally vertical section for spacing the receiver from the gutter flange.

16. The gutter cover set forth in claim 15 wherein the receiver is configured to extend downward into the gutter and perpendicular to the fastening portion.

17. The gutter cover set forth in claim 13 further comprising at least one rib formed in the covering portion for stiffening the sheet and for promoting smooth, even lateral distribution of water flow.

18. The gutter cover set forth in claim 17 wherein the covering portion includes at least two of said ribs.

19. The gutter cover set forth in claim 18 wherein each rib projects upwardly.

20. The gutter cover set forth in claim 19 wherein each rib is formed by four bends formed in the covering portion.

21. A gutter cover for preventing debris from falling into the gutter and for directing water flow into the gutter, the gutter cover comprising:

an elongate continuous sheet having a longitudinal axis transverse to a water flow direction, the sheet including:

a shingle mounting portion for reception between a roof shingle and roof;

a covering portion adjacent the shingle mounting portion and sized to extend over the gutter;

a curved portion downstream from the covering portion for directing water into the gutter;

said curved portion comprising a surface tension curve comprising an upper rearward opening concave curve defined by a first radius and a lower rearward opening concave curve defined by a second radius larger than the first radius;

a lowermost edge disposed downstream from the curved portion;

a clip including a fastening portion for fastening the clip to a flange of the gutter, a receiver for receiving the lowermost edge of the cover and a step-shaped spacing portion for spacing the cover from the flange, said step-shaped spacing portion comprising a generally vertical section extending from said fastening portion of the clip for contact with the gutter flange and a generally horizontal section extending from the generally vertical section for spacing the receiver and lowermost edge of the cover from the gutter flange, and wherein said first radius is in the range of ⅛ in. to ½ in.

22. The gutter cover set forth in claim 21 wherein the receiver extends downward into the gutter and perpendicular to the fastening portion.

23. The gutter cover set forth in claim 21 wherein the receiver of the clip includes at least one barb for inhibiting withdrawal of the cover from the clip.

24. The gutter cover set forth in claim 21 wherein the fastening portion includes an opening for receiving a screw for attaching the clip to the gutter.

25. The gutter cover set forth in claim 1 wherein said second radius is in the range of ¼ in. to one in.

26. The gutter cover set forth in claim 1 wherein said surface tension curve has a height of about ½ in.

27. The gutter cover set forth in claim 13 wherein said second radius is in the range of ¼ in. to one in.

28. The gutter cover set forth in claim 13 wherein said surface tension curve has a height of about ½ in.

29. The gutter cover set forth in claim 21 wherein said second radius is in the range of ¼ in. to one in.

30. The gutter cover set forth in claim 21 wherein said surface tension curve has a height of about ½ in.

31. The gutter cover set forth in claim 25 wherein said surface tension curve has a height of about ½ in.

32. The gutter cover set forth in claim 31 further comprising a flange having an angled upper portion connected to the lower rearward opening concave curve of the surface tension curve and a substantially vertical lower portion having holding ribs configured for engagement with holding clips for securing the gutter cover to the gutter.

33. The gutter cover set forth in claim 1 wherein said upper rearward opening concave curve and said lower rearward opening concave curve are connected to form a continuously curved surface, and wherein said surface tension curve has a height of about ½ in.

* * * * *